US011724529B2

(12) United States Patent
Takahashi

(10) Patent No.: US 11,724,529 B2
(45) Date of Patent: Aug. 15, 2023

(54) RECORDING DEVICE

(71) Applicant: SEIKO EPSON CORPORATION, Tokyo (JP)

(72) Inventor: Yoji Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/455,147

(22) Filed: Nov. 16, 2021

(65) Prior Publication Data

US 2022/0153046 A1 May 19, 2022

(30) Foreign Application Priority Data

Nov. 19, 2020 (JP) ..... 2020-192746

(51) Int. Cl.
*B41J 29/13* (2006.01)
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS 6,113,207 A * 9/2000 Nakano ..... H04N 1/00557 347/3
6,246,591 B1 * 6/2001 Ikeda ..... H01R 13/72 174/72 A
2013/0256028 A1 * 10/2013 Oiwa ..... B60R 16/0215 174/72 A
2015/0343632 A1 * 12/2015 Penn ..... B25J 9/1045 74/490.09
2020/0156372 A1 5/2020 Okamura et al.

FOREIGN PATENT DOCUMENTS

JP 2020-082444 A 6/2020

* cited by examiner

*Primary Examiner* — Erica S Lin
*Assistant Examiner* — Tracey M McMillion
(74) *Attorney, Agent, or Firm* — Workman Nydegger

(57) ABSTRACT

A recording device includes a recording unit configured to perform recording on a medium, a plurality of cables, a substrate having a first surface provided with a plurality of coupling units to which the plurality of cables are respectively coupled and a second surface opposite to the first surface, a facing member configured to face the second surface, and a supporting member configured to define a space between the facing member and the substrate by supporting the substrate, and the plurality of cables extend through the space.

7 Claims, 5 Drawing Sheets

RECORDING DEVICE

The present application is based on, and claims priority from JP Application Serial Number 2020-192746, filed Nov. 19, 2020, the disclosure of which is hereby incorporated by reference herein in its entirety.

BACKGROUND

1. Technical Field

The present disclosure relates to a recording device.

2. Related Art

JP-A-2020-82444 describes a printer which is an example of a recording device for recording on a medium. The printer includes a plurality of cables and a substrate including coupling units to which the cables are coupled. The substrate has a first surface at which the coupling units are provided and a second surface opposite to the first surface. The cables are routed at the first surface in accordance with the arrangement of the coupling units.

In such a recording device, when the cables are routed at the first surface in accordance with the arrangement of the coupling units, the cables are likely to interfere with each other at the first surface. When the cables interfere with each other at the first surface, the coupling of the cable to the coupling unit may become unstable.

SUMMARY

A recording device for solving the above-described problems includes a recording unit configured to perform recording on a medium, a plurality of cables, a substrate having a first surface provided with a plurality of coupling units to which the plurality of cables are respectively coupled and a second surface opposite to the first surface, a facing member configured to face the second surface, and a supporting member configured to define a space between the facing member and the substrate by supporting the substrate, and the plurality of cables extend through the space.

DESCRIPTION OF EXEMPLARY EMBODIMENTS

One exemplary embodiment of a recording device will be described below with reference to the accompanying drawings. The recording device is, for example, an ink jet printer that records images such as characters and photographs by ejecting ink, which is an example of a liquid, onto a sheet, which is an example of a medium.

Figure 1:
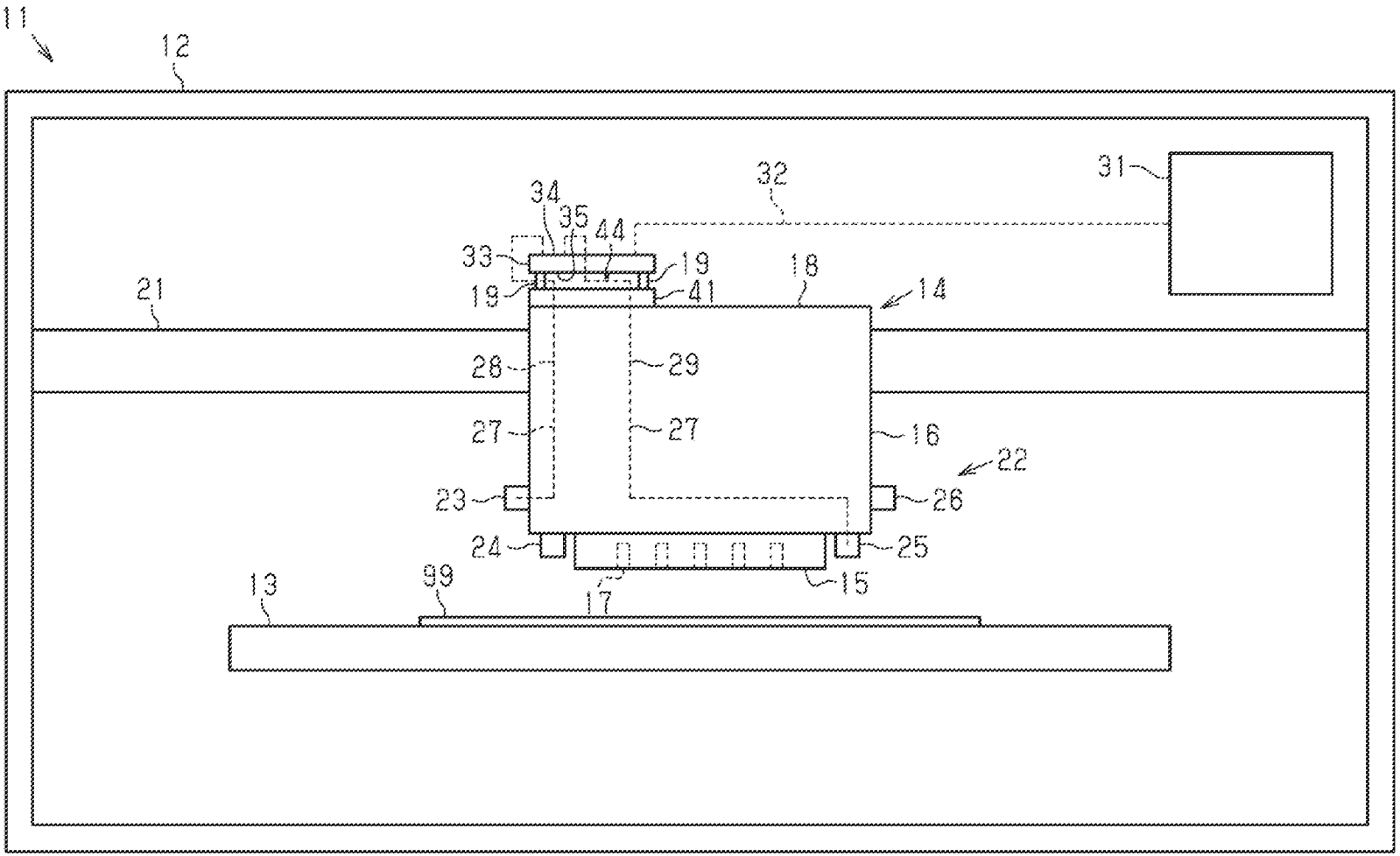
FIG. 1 is a front view illustrating an exemplary embodiment of a recording device.

As illustrated in FIG. 1, a recording device 11 includes a housing 12. The housing 12 accommodates various configurations included in the recording device 11.

The recording device 11 includes a support 13. The support 13 supports, for example, a medium 99 to be transported.

The recording device 11 includes a recording unit 14. The recording unit 14 is configured to perform recording on the medium 99. The recording unit 14 is located, for example, so as to face the support 13. The recording unit 14 records an image on, for example, the medium 99 supported by the support 13. The recording unit 14 includes, for example, a head 15 and a carriage 16.

The head 15 includes one or more nozzles 17. The head 15 records an image on the medium 99 by ejecting liquid from the nozzle 17 onto the medium 99. The head 15 includes, for example, the same number of piezoelectric elements as the number of nozzles 17. When a voltage is applied to the piezoelectric element, liquid is ejected from the nozzle 17.

The carriage 16 mounts the head 15. The carriage 16 moves relative to the medium 99 supported by the support 13. As described above, the recording device 11 is, for example, a serial printer. The recording device 11 may be a line printer capable of ejecting the liquid simultaneously across a width of the medium 99.

The carriage 16 has an upper surface 18. The upper surface 18 is a surface of the carriage 16 facing upward.

The carriage 16 includes, for example, a supporting member 19. The supporting member 19 is a member that supports a substrate 33, which will be described later. It can be said that the recording device 11 includes the supporting member 19. The carriage 16 of this example supports the substrate 33. Therefore, the carriage 16 also functions as a support portion that supports the substrate 33.

In this example, one or more supporting members 19 are provided. The supporting member 19 protrudes from the upper surface 18, for example. The supporting member 19 is, for example, a boss. The shape of the boss is, for example, a cylindrical shape. The supporting member 19 supports the substrate 33 with a tip end of the supporting member 19 in contact with the substrate 33.

The recording device 11 includes, for example, a guide member 21. The guide member 21 is, for example, a long member extending across a width of the housing 12. The guide member 21 is, for example, a sheet metal, but may be a rod. The guide member 21 is secured to the housing 12. The guide member 21 guides the carriage 16 and supports the carriage 16. The carriage 16 moves relative to medium 99 by moving along the guide member 21.

The recording device 11 includes, for example, a detector 22. The detector 22 is constituted of, for example, one or a plurality of sensors. In this example, the plurality of sensors are provided. The plurality of sensors are, for example, a first sensor 23 that detects a width of the medium 99, a second sensor 24 that detects a distance between the support 13 and the head 15, a third sensor 25 that detects contact with the medium 99, a fourth sensor 26 that detects a mark recorded on the medium 99, and the like. The recording device 11 may further include a fifth sensor that detects a position of the carriage 16, a sixth sensor that detects a temperature of the head 15, and the like. The respective sensors 23, 24, 25, and 26 may be attached to, for example, the recording unit 14. The respective sensors 23, 24, 25, and 26 may be attached to, for example, the carriage 16.

The first sensor 23 is, for example, an optical sensor. The first sensor 23 detects the width of the medium 99 by detecting the edge of the medium 99. The second sensor 24 is, for example, an optical sensor. The second sensor 24 detects the distance between the support 13 and the head 15 by irradiating the support 13 with light. The third sensor 25 is, for example, an actuator. The fourth sensor 26 is, for example, an optical sensor. The fifth sensor is, for example, an encoder, and the sixth sensor is, for example, a thermistor.

The recording device 11 includes a plurality of cables 27. The plurality of cables 27 are coupled to, for example, the detector 22. Although FIG. 1 illustrates a cable 27 coupled to the first sensor 23 and a cable 27 coupled to the third sensor 25, the number of the cables 27 actually provided is equal to or greater than the number of sensors. The plurality of cables 27 each have flexibility, for example. For example, the plurality of cables 27 include at least one flexible flat cable 28. In other words, one or more of the plurality of cables 27 are the flexible flat cables 28. For example, the plurality of cables 27 include at least one twisted pair cable 29. In other words, the plurality of cables 27 include one or more twisted pair cables 29. The at least one twisted pair cable 29 is a cable obtained by twisting two or more cables 27. That is, two or more cables 27 twisted together constitute one twisted pair cable 29. A cable obtained by twisting two cables 27 together is a so-called twisted pair cable.

The recording device 11 includes a control unit 31. The control unit 31 controls various configurations of the recording device 11. The control unit 31 can be constituted as a circuit including, for example, α: one or more processors that execute various kinds of processing in accordance with a computer program, β: one or more dedicated hardware circuits such as an integrated circuit for a specific application that executes at least part of the various kinds of processing, or γ: a combination thereof. The processor includes a CPU and a memory such as a RAM or a ROM, and the memory stores a program code or a command configured to cause the CPU to execute the processing. The memory, or a computer readable medium, includes any medium accessible by a general purpose or special purpose computer. The control unit 31 is fixed to the housing 12 using a fixing member such as a screw.

The recording device 11 includes a wire 32. The wire 32 is coupled to the control unit 31. The control unit 31 and the detector 22 are electrically coupled by the plurality of cables 27 and the wire 32. Signals detected by the detector 22 are input to the control unit 31 through the plurality of cables 27 and the wire 32. The wire 32 is flexible, for example. Thus, the shape of the wire 32 is changed so as to follow the carriage 16 as the carriage 16 moves.

Figure 2:
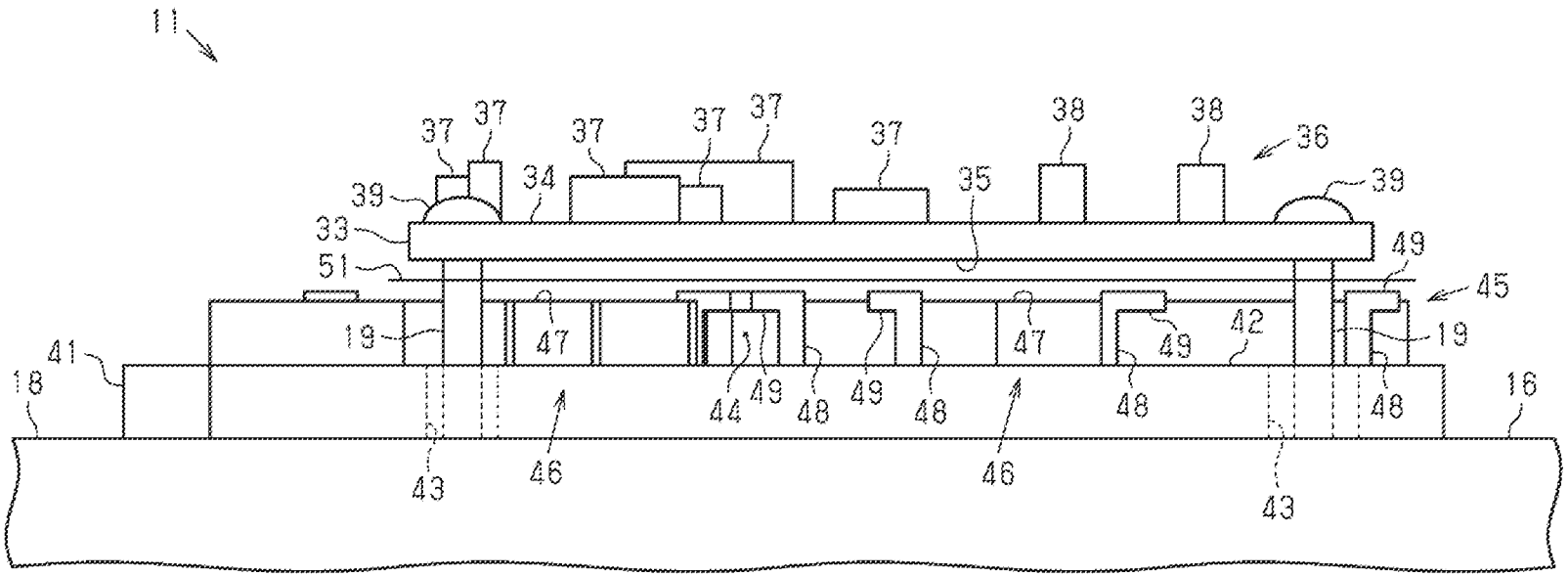
FIG. 2 is an enlarged view of FIG. 1.

As illustrated in FIGS. 1 and 2, the recording device 11 includes the substrate 33. The substrate 33 has a first surface 34 and a second surface 35. The first surface 34 is a surface to which the cable 27, the wire 32, and the like are coupled. The first surface 34 is, for example, a surface facing upward. The second surface 35 is a surface opposite to the first surface 34. The second surface 35 is, for example, a surface facing downward. The second surface 35 is in contact with the tip end of the supporting member 19. Therefore, the substrate 33 is located at the supporting member 19.

Figure 3:
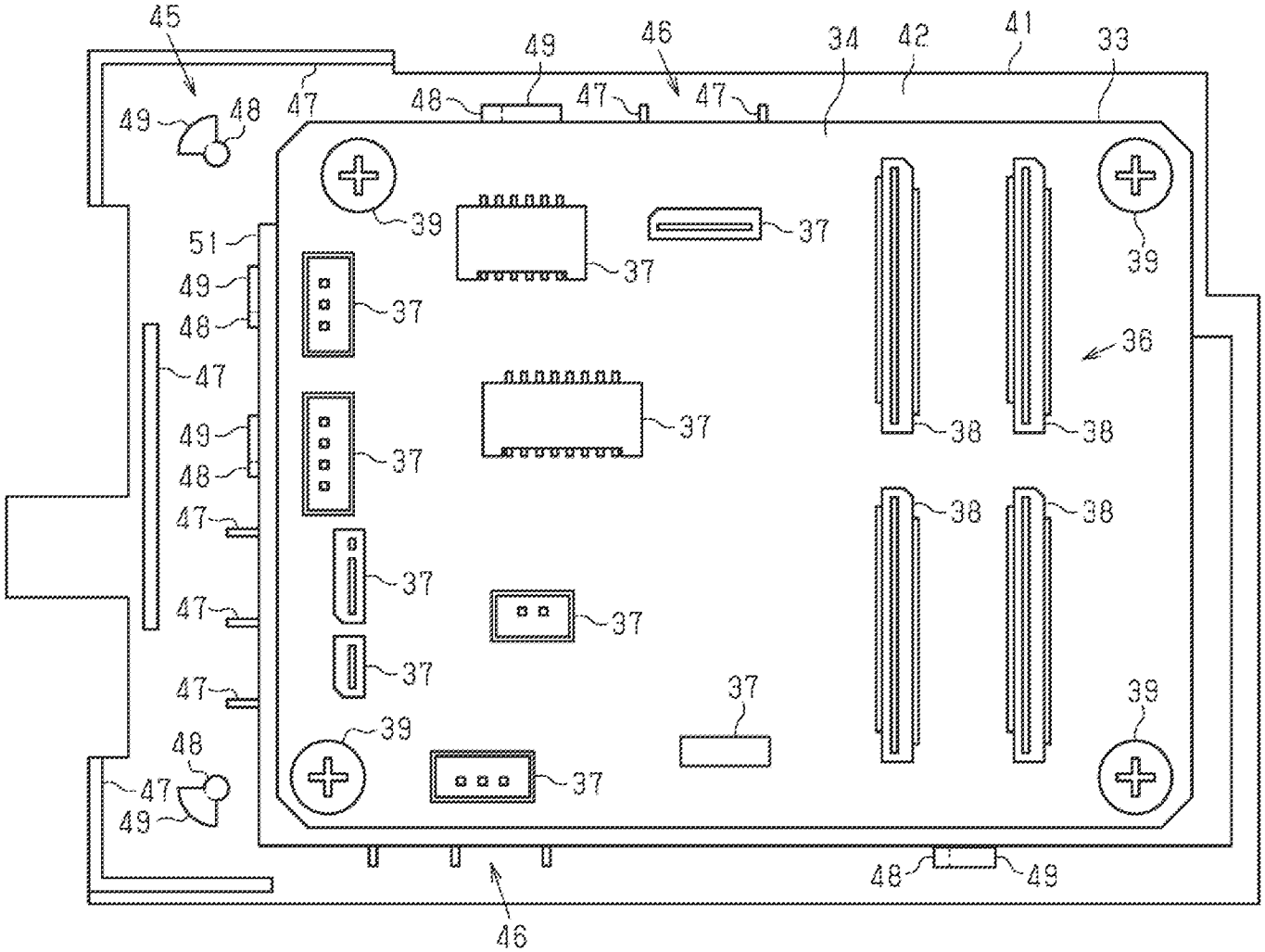
FIG. 3 is a plan view of a substrate.

As illustrated in FIGS. 2 and 3, the substrate 33 has a plurality of coupling units 36. The plurality of coupling units 36 are provided at the first surface 34. The coupling unit 36 is, for example, a connector. Of the plurality of coupling units 36, some are first coupling units 37 to which the cables 27 are coupled, and some are second coupling units 38 to which the wires 32 are coupled. In this example, a plurality of first coupling units 37 and a plurality of second coupling units 38 are provided.

The substrate 33 is coupled to the detector 22 by coupling the cable 27 to the first coupling unit 37. The substrate 33 is coupled to the control unit 31 by coupling the wire 32 to the second coupling unit 38. That is, the substrate 33 relays the control unit 31 and the detector 22. In other words, the detector 22 is coupled to the control unit 31 via the substrate 33. The substrate 33 may be coupled not only to the sensors 23, 24, 25, and 26, but also to the piezoelectric element of the head 15 by the cable 27 and the first coupling unit 37, or may be coupled to other configurations.

The substrate 33 is attached to the supporting member 19 by, for example, a fixing member 39. The fixing member 39 is, for example, a screw. In this example, a plurality of fixing members 39 are provided. The plurality of fixing members 39 fix the substrate 33 to the supporting members 19 at four corners when the first surface 34 is viewed in plan view. Thus, the supporting members 19 are provided so as to correspond to the four corners of the substrate 33.

As illustrated in FIG. 2, the recording device 11 includes a facing member 41. The facing member 41 is a member facing the second surface 35. The facing member 41 has a facing surface 42 that faces the second surface 35. The facing surface 42 is, for example, a surface facing upward. The facing member 41 is supported by, for example, the carriage 16, which is the support portion. The facing member 41 is located at the upper surface 18. The facing member 41 is located between the upper surface 18 and the second surface 35.

Figure 4:
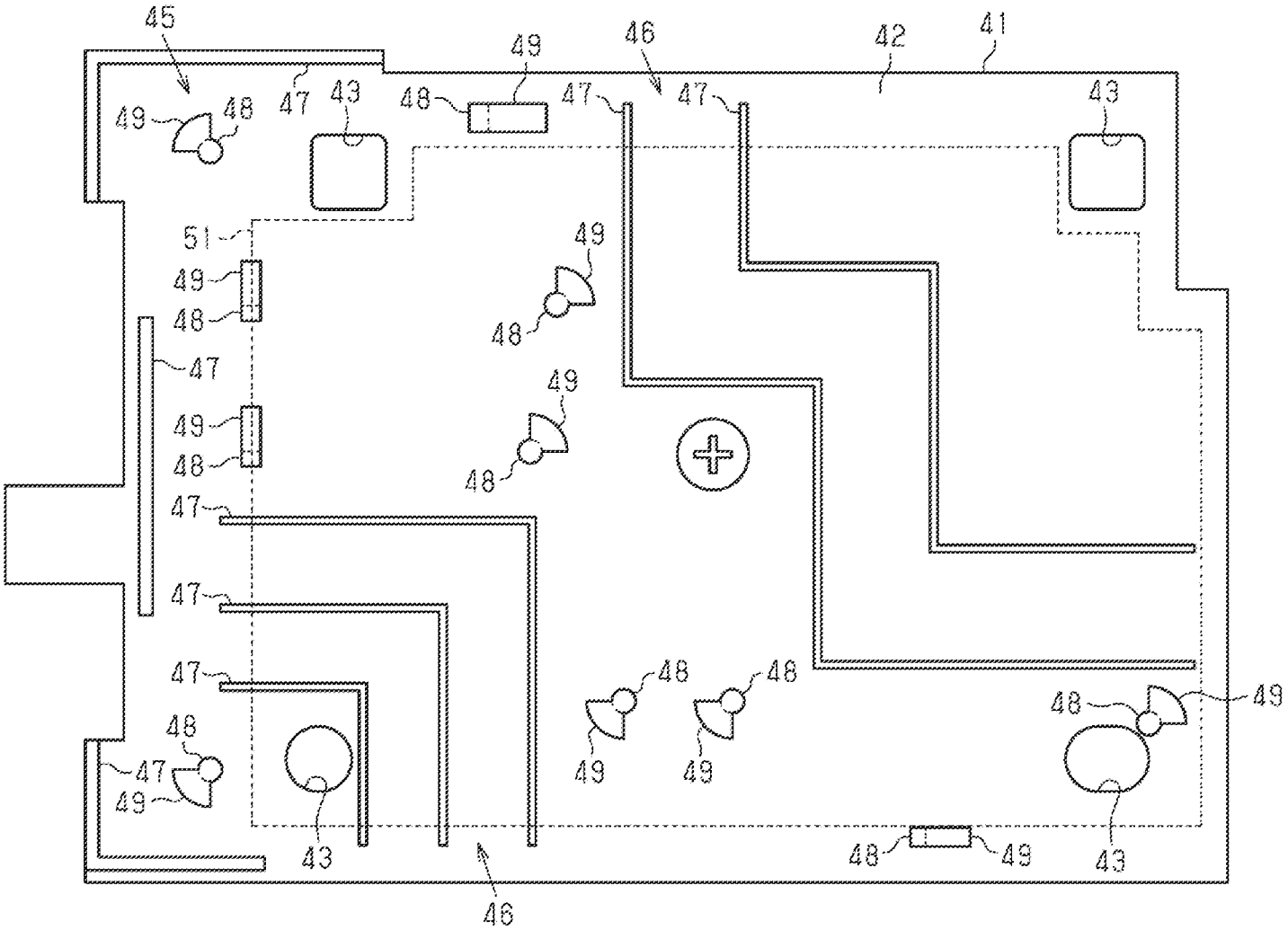
FIG. 4 is a plan view of a facing member.

As illustrated in FIGS. 2 and 4, the facing member 41 has a hole 43 into which the supporting member 19 is inserted. Therefore, the number of holes 43 is equal to the number of supporting members 19. A plurality of holes 43 are provided at four corners of the facing member 41. By inserting the supporting member 19 into the hole 43, the facing member 41 is attached to the carriage 16 in a state where the position to the carriage 16 which is the support portion is determined. Some of the plurality of holes 43 are, for example, elongated holes. With this, the plurality of supporting members 19 can be easily inserted into the plurality of holes 43. The facing member 41 may be fixed to the carriage 16, which is the support portion by, for example, a screw in a state where the supporting member 19 is inserted into the hole 43. The facing member 41 is constituted of a member different from the carriage 16, which is the support portion, but may be integrally configured with the carriage 16, which is the support portion, as a single component. In other words, the facing member 41 may be part of the support portion.

A thickness of the facing member 41 is smaller than a length of the supporting member 19. The thickness of the facing member 41 is a distance from the facing surface 42 to a surface opposite to the facing surface 42. In other words, the thickness of the facing member 41 is smaller than a distance from the upper surface 18 to the tip end of the supporting member 19. Therefore, the supporting member 19 protrudes from the inserted hole 43. Accordingly, by supporting the substrate 33 with the supporting member 19, a space 44 is formed between the facing member 41 and the substrate 33. Specifically, the space 44 is formed between the second surface 35 and the facing surface 42. In this way, the supporting member 19 defines the space 44 by supporting the substrate 33.

In this example, when the substrate 33 and the facing member 41 are viewed in plan view, an area of the facing surface 42 is larger than an area of the second surface 35. Therefore, there is a region at the facing surface 42 that does not face the second surface 35. The space 44 is a space that includes a region where the facing surface 42 faces the second surface 35 and does not include the region where the facing surface 42 does not face the second surface 35. In other words, the space 44 is a space defined by a region where the substrate 33 and the facing member 41 overlap when the substrate 33 and the facing member 41 are viewed in plan view.

The space 44 is a space through which the plurality of cables 27 pass. By passing the cable 27 through the space 44, the cable 27 may be routed in the space 44 in accordance with the arrangement of the first coupling unit 37. As a result, there is no need to route the cable 27 at the first surface 34. Therefore, the cables 27 are less likely to interfere with each other at the first surface 34. Accordingly, the possibility that the coupling of the cable 27 to the first coupling unit 37 becomes unstable can be reduced. In particular, when the carriage 16 moves as in this example, for example, since the plurality of cables 27 are likely to interfere with each other due to the inertia and vibration of the plurality of cables 27, the effect of routing the cables 27 in the space 44 is great. Further, when the cable 27 is routed at the first surface 34, it becomes difficult to couple the cable 27 to the first coupling unit 37.

By passing the cable 27 through the space 44, the posture of the cable 27 is stabilized. By passing the cable 27 through the space 44 sandwiched between the substrate 33 and the facing member 41, even when the cable 27 moves, the cable 27 comes into contact with the substrate 33 or the facing member 41. In other words, the cable 27 is held by the substrate 33 and the facing member 41. By holding the cable 27 in the space 44, the posture of the cable 27 is stabilized.

In addition, in this example, a space above the first surface 34 is not defined, but the space 44 between the second surface 35 and the facing surface 42 is defined. In other words, the space 44 between the surface of the substrate 33 opposite to the surface at which the first coupling unit 37 is provided and the facing surface 42 is defined. As a result, compared with a case where the space above the first surface 34 is defined, the possibility that the facing member 41 overlaps with the first coupling unit 37 is reduced when the first surface 34 is viewed in plan view. Accordingly, a user of the recording device 11 and an operator who maintains the recording device 11 can easily access the first coupling unit 37. Therefore, the cable 27 can be easily coupled to the first coupling unit 37 or removed from the first coupling unit 37.

The smaller the distance between the facing member 41 and the substrate 33, the more stable the posture of the cable 27. For example, when the distance between the facing member 41 and the substrate 33 is substantially the same as a thickness of the cable 27, the posture of the cable 27 is likely to be stable.

Figure 5:
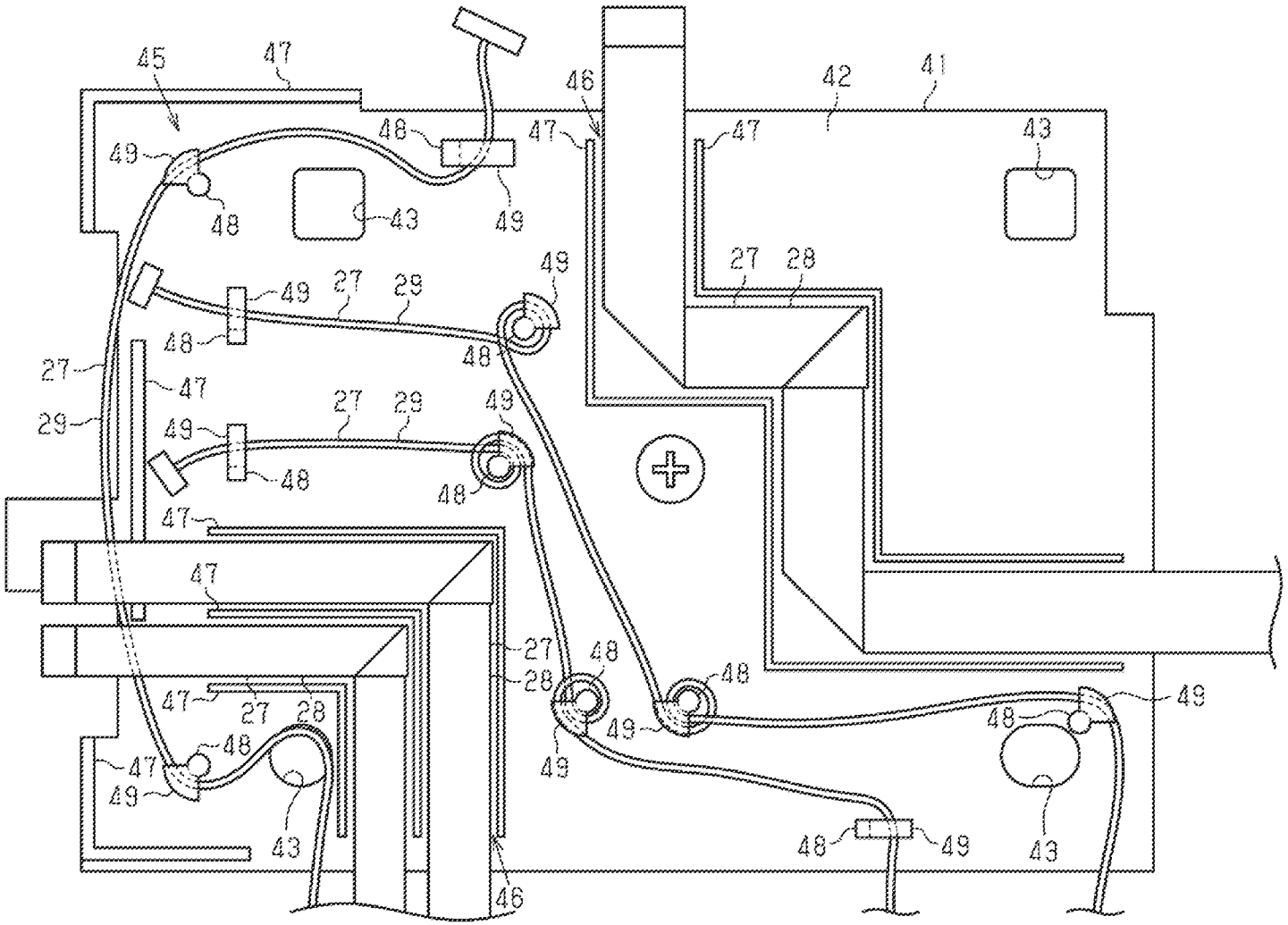
FIG. 5 is a plan view of the facing member at which cables are disposed.

As illustrated in FIGS. 4 and 5, the facing member 41 includes a route defining portion 45 that defines routes of the plurality of cables 27. The route defining portion 45 is provided at the facing surface 42. The route defining portion 45 guides the cable 27 by defining the route of the cable 27. For example, the route defining portion 45 guides a portion of the cable 27 that passes through the space 44. As a result, the posture of the cable 27 is stabilized. In this example, since the route defining portion 45 is also provided in the region at the facing surface 42 that does not face the second surface 35, a portion of the cable 27 that does not extend through the space 44 may be guided.

For example, the route defining portion 45 includes an accommodating portion 46 that accommodates the cable 27. The accommodating portion 46 guides the cable 27 by accommodating the cable 27. The accommodating portion 46 is constituted of, for example, a rib 47 that protrudes from the facing surface 42, but may be constituted of a groove recessed from the facing surface 42. In this example, a plurality of ribs 47 are provided at the facing surface 42 and extend at the facing surface 42. The plurality of ribs 47 include ribs 47 that constitute the accommodating portion 46 and ribs 47 that does not constitute the accommodating portion 46.

By accommodating the cable 27 in the accommodating portion 46, the cable 27 is routed along the arrangement of the accommodating portion 46. That is, the cable 27 is routed along the ribs 47. Specifically, a portion of the cable 27 that passes through at least the space 44 is routed along the ribs 47. In this way, the accommodating portion 46 defines the route of the cable 27.

The accommodating portion 46 accommodates, for example, at least part of the flexible flat cable 28. In this example, part of the flexible flat cable 28 is accommodated in the accommodating portion 46. Therefore, the route defined by the accommodating portion 46 is the route of the flexible flat cable 28.

For example, the route defining portion 45 includes a pin 48 around which the cable 27 is wound. The pin 48 protrudes from the facing surface 42. By winding the cable 27 around the pin 48, the cable 27 is routed along the arrangement of the pin 48. The pin 48 guides the wound cable 27. In this way, the pin 48 defines the route of the cable 27.

For example, the twisted pair cable 29 is wound around the pin 48. Thus, the route defined by the pin 48 is the route of the twisted pair cable 29. The pin 48 may define a route of the flexible flat cable 28. The accommodating portion 46 may define a route of the twisted pair cable 29. Terminals coupled to the first coupling units 37 are provided at tip ends of the flexible flat cable 28 and the twisted pair cable 29. After being guided by the route defining portion 45, the cable 27 is routed to a region facing the first surface 34, that is, above the substrate 33, and is coupled to the first coupling unit 37. Although FIG. 5 illustrates the twisted pair cable 29 as one cable 27 for simplicity of illustration, a plurality of cables 27 are actually twisted.

The pin 48 may include a restricting portion 49. The restricting portion 49 is in contact with the wound twisted pair cable 29, thereby suppressing the separation of the twisted pair cable 29 from the pin 48. The restricting portion 49 is, for example, a protrusion. The restricting portion 49 is provided at a tip end of the pin 48, for example. The restricting portion 49 extends, for example, parallel to the facing surface 42. In this way, the restricting portion 49 functions as a hook for restricting the movement of the cable 27 wound around the pin 48 toward the substrate 33. As a result, the separation of the cable 27 is suppressed.

The pin 48 may be provided such that a diameter increases from the base end to the tip end of the pin 48. That is, the shape of the pin 48 may be a cone shape. In this case as well, the separation of the cable 27 wound around the pin 48 is suppressed. In this case, the shape of the pin 48 that suppresses the separation of the cable 27 has a function of the restricting portion 49.

In this example, a length of the pin 48 is greater than a length of the rib 47. The length of the pin 48 may be smaller than the length of the rib 47. In other words, a distance from the facing surface 42 to the tip end of the pin 48 may be greater than or smaller than a distance from the facing surface 42 to the tip end of the rib 47. A value obtained by adding the thickness of the facing member 41 and the length of the rib 47 is less than or equal to the length of the supporting member 19. A value obtained by adding the thickness of the facing member 41 and the length of the pin 48 is less than or equal to the length of the supporting member 19.

As illustrated in FIGS. 3 and 4, the recording device 11 may include an insulating member 51. The insulating member 51 is, for example, a sheet or film made of an insulating material. The insulating member 51 is, for example, a polyester film.

The insulating member 51 is located, for example, between the substrate 33 and the facing member 41. The insulating member 51 has a hole into which the supporting member 19 is inserted. The insulating member 51 is attached to the supporting member 19 by inserting the supporting member 19 into the hole of the insulating member 51. As a result, the insulating member 51 is located at the facing member 41. The insulating member 51 is located so as to be placed at top of the rib 47 and the pin 48, for example.

The insulating member 51 insulates the substrate 33 from the cable 27. Specifically, the insulating member 51 suppresses the contact between the portion of the cable 27 passing through the space 44 and the second surface 35. When the cable 27 comes into direct contact with the second surface 35, the cable 27 may be damaged. Therefore, by providing the insulating member 51, damage to the cable 27 is suppressed.

Next, the functions and effects of the exemplary embodiment described above will be described.

(1) The plurality of cables 27 extend through the space 44. According to this configuration, the cables 27 can be routed in the space 44 between the substrate 33 and the facing member 41. As a result, there is no need to route the cables 27 at the first surface 34, so that the cables 27 are less likely to interfere with each other. Accordingly, the possibility that the coupling of the cable 27 to the first coupling unit 37 becomes unstable can be reduced. Further, the plurality of cables 27 are held by the substrate 33 and the facing member 41 by passing through the space 44. As a result, the posture of the cables 27 are stabilized. By stabilizing the posture of the cables 27, the amount of noise caused by the cables 27 approaching each other can be controlled.

(2) The tip end of the supporting member 19 is in contact with the second surface 35. According to this configuration, the space 44 between the facing member 41 and the substrate 33 can be defined with a relatively simple configuration.

(3) The facing member 41 includes the route defining portion 45 that defines the routes of the plurality of cables 27. According to this configuration, the plurality of cables 27 are routed along the routes defined by the route defining portion 45. As a result, it is not necessary to route the plurality of cables 27 at the first surface 34. Therefore, the cables are less likely to interfere with each other at the first surface 34. Further, by guiding the cables 27 by the route defining portion 45, the posture of the cables 27 is stabilized.

(4) The route defining portion 45 includes the accommodating portion 46 that accommodates a portion of the flexible flat cable 28. According to this configuration, by accommodating the flexible flat cable 28 in the accommodating portion 46, the flexible flat cable 28 is routed along the route defined by the accommodating portion 46. As a result, the cables 27 are less likely to interfere with each other at the first surface 34.

(5) The route defining portion 45 includes the pin 48 around which the twisted pair cable 29 is wound. According to this configuration, by being wound around the pin 48, the twisted pair cable 29 is routed along the route defined by the pin 48. As a result, the cables 27 are less likely to interfere with each other at the first surface 34.

(6) The pin 48 includes the restricting portion 49 that restricts the separation of the twisted pair cable 29 that is wound around the pin 48. According to this configuration, the twisted pair cable 29 can be routed in a stable state.

(7) The recording device 11 includes the insulating member 51 that insulates the substrate 33 from the cable 27 between the facing member 41 and the substrate 33. According to this configuration, the risk of damage to the cable 27 due to the cable 27 coming into direct contact with the second surface 35 can be reduced.

The present exemplary embodiment described above may be modified as follows. The present exemplary embodiment and modified examples thereof to be described below may be implemented in combination within a range in which a technical contradiction does not arise.

The supporting member 19 may be provided in, for example, the housing 12 instead of being provided in the carriage 16. In other words, the support portion is not limited to the configuration of the carriage 16, but may be the configuration of another unit.

The rib 47 or the pin 48 may also serve as the supporting member 19.

The liquid ejected by the head 15 is not limited to ink, and may be, for example, a liquid material constituted by dispersing or mixing particles of a functional material in liquid. For example, the head 15 may eject a liquid material containing a material such as an electrode material or a pixel material used for manufacturing a liquid crystal display, an electroluminescent display, and a surface emitting display in a dispersed or dissolved form.

Hereinafter, technical concepts and effects thereof that are understood from the above-described exemplary embodiments and modified examples will be described.

(A) A recording device includes a recording unit configured to perform recording on a medium, a plurality of cables, a substrate having a first surface provided with a plurality of coupling units to which the plurality of cables are respectively coupled and a second surface opposite to the first surface, a facing member configured to face the second surface, and a supporting member configured to define a space between the facing member and the substrate by supporting the substrate, and the plurality of cables extend through the space.

According to this configuration, the cable can be routed in the space between the substrate and the facing member in accordance with the arrangement of the coupling unit. As a result, there is no need to route the cables at the first surface, so that the cables are less likely to interfere with each other at the first surface. Accordingly, the possibility that the coupling of the cable to the coupling unit becomes unstable can be reduced.

(B) In the recording device described above, the facing member may have a hole into which the supporting member is inserted, and a tip end of the supporting member may be in contact with the second surface.

According to the configuration described above, the space between the facing member and the substrate can be defined with a relatively simple configuration.

(C) In the recording device described above, the facing member may include a route defining portion configured to define routes of the plurality of cables.

According to the configuration described above, the plurality of cables are routed along the routes defined by the route defining portion. As a result, it is not necessary to route the plurality of cables at the first surface. Therefore, the cables are less likely to interfere with each other at the first surface.

(D) In the recording device described above, at least one of the plurality of cables may be a flexible flat cable, and the route defining portion may include at least one accommodating portion configured to accommodate the flexible flat cable.

According to the configuration described above, by accommodating the flexible flat cable in the accommodating portion, the flexible flat cable is routed along a route defined by the accommodating portion. As a result, the cables are less likely to interfere with each other at the first surface.

(E) In the recording device described above, some of the plurality of cables may constitute at least one twisted pair cable, the at least one twisted pair cable may be a cable obtained by twisting two or more of the cables, and the route defining portion may include a pin around which the twisted pair cable is wound.

According to the above configuration, by being wound around the pin, the twisted pair cable is routed along a route defined by the pin. As a result, the cables are less likely to interfere with each other at the first surface.

(F) In the recording device described above, the pin may include a restricting portion configured to restrict separation of the twisted pair cable from the pin by being in contact with the twisted pair cable wound around the pin.

According to the configuration described above, the twisted pair cable can be routed in a stable state.

(G) The recording device described above may include an insulating member configured to insulate the substrate from the cable between the facing member and the substrate.

According to the configuration described above, the risk of damage to the cable due to the cable coming into direct contact with the second surface can be reduced.

What is claimed is:

1. A recording device comprising:

a recording unit configured to perform recording on a medium;

a plurality of cables;

a substrate having a first surface provided with a plurality of coupling units to which the plurality of cables are respectively coupled and a second surface opposite to the first surface;

a facing member configured to face the second surface;

a supporting member configured to define a space between the facing member and the substrate by supporting the substrate; and a pair of ribs extending from the facing member within the space, the pair of ribs forming a portion of an accommodating portion configured to receive a flexible flat cable configured to couple to one of the plurality of coupling units, the flexible flat cable being different from the plurality of cables, wherein the plurality of cables extend through the space.

2. The recording device according to claim 1, wherein the facing member has a hole into which the supporting member is inserted, and a tip end of the supporting member is in contact with the second surface.

3. The recording device according to claim 1, wherein the facing member includes a route defining portion configured to define routes of the plurality of cables.

4. The recording device according to claim 3, wherein the plurality of cables include at least one flexible flat cable, and the route defining portion includes at least one accommodating portion configured to accommodate the at least one flexible flat cable.

5. The recording device according to claim 3, wherein the plurality of cables include at least one twisted pair cable, the at least one twisted pair cable is a cable obtained by twisting two or more of the cables, and the route defining portion includes a pin around which the twisted pair cable is wound.

6. The recording device according to claim 5, wherein the pin includes a restricting portion configured to restrict separation of the twisted pair cable from the pin by being in contact with the twisted pair cable wound around the pin.

7. The recording device according to claim 1, comprising, between the facing member and the substrate, an insulating member configured to insulate the substrate from the cable.

* * * * *